US006843241B1

(12) United States Patent
Newcomer

(10) Patent No.: US 6,843,241 B1
(45) Date of Patent: Jan. 18, 2005

(54) SOFT TOSS PITCHING MACHINE

(76) Inventor: David K. Newcomer, 450 Sand Hill, Montoursville, PA (US) 17754

( * ) Notice: Subject to any disclaimer, the term of this patent is extended or adjusted under 35 U.S.C. 154(b) by 0 days.

(21) Appl. No.: 10/708,980

(22) Filed: Apr. 5, 2004

(51) Int. Cl.[7] ..... A63B 65/12; F41B 7/00
(52) U.S. Cl. ..... 124/16; 124/37; 473/451
(58) Field of Search ..... 124/16, 17, 37; 473/451

(56) References Cited

U.S. PATENT DOCUMENTS 4,004,567 A * 1/1977 Henderson ..... 124/61
4,132,214 A 1/1979 Schnurr et al.
4,209,004 A * 6/1980 Kennedy ..... 124/7
5,066,010 A 11/1991 Pingston
5,067,471 A * 11/1991 Kim ..... 124/21
5,421,313 A 6/1995 Strayer
5,619,977 A * 4/1997 Gatin ..... 124/7
6,089,215 A * 7/2000 Morris et al. ..... 124/16
6,176,230 B1 * 1/2001 Thompson ..... 124/16

* cited by examiner

*Primary Examiner*—John A. Ricci
(74) *Attorney, Agent, or Firm*—John J. Elnitski, Jr.

(57) ABSTRACT

A pitching machine that includes a support frame, a ball tube assembly adapted to store and launch the ball. The ball tube assembly is multi-curved and configure such that the ball rolls in the ball tube assembly due to gravity towards a ball rest end for launching. The pitching machine includes a release assembly positioned along the ball tube assembly, the release assembly configured to release the ball from a storage position to a firing position. The pitching machine includes a ball firing assembly positioned beyond the release assembly and along the ball tube assembly, the ball firing assembly configured to launch the ball after being released by the release assembly. The pitching machine includes a control unit adapted to be used by the hitter, the control unit connected to the release assembly and the ball firing assembly to activate the release assembly and the ball firing assembly.

20 Claims, 14 Drawing Sheets

SOFT TOSS PITCHING MACHINE

BACKGROUND OF INVENTION

The present invention generally relates to baseball pitching machines. More specifically, the present invention relates to pitching machines for simulating a soft toss pitch from a coach.

There are many pitching machines on the market. Most of the pitching machines are designed to simulate a pitcher delivering a pitch from a pitcher"s mound to a live hitter at Home Plate. Soft toss pitches are commonly used as a baseball hitting drill to improve a hitter's hand/eye coordination, timing, and bat speed. This drill is used by coaches and players from Little League on up to the Major Leagues. Normally, a coach kneels to the side of the hitter, just outside the strike zone, and underhand-tosses a ball into the strike zone where the hitter hits it. There are a few Soft-Toss devices on the market, however they lack certain features to simulate a coach tossing the baseball. For example, one device may toss a ball into the air, but the machine is designed to use light-weight balls, as a toy and does not use real baseballs. Another machine may toss baseballs, but the ball height or angle cannot be adjusted. In addition, most of these machines use battery or electrical power to run motors, which are timed. They toss a ball every five or six seconds, which does not allow for a pause for instruction unless the machine is turned off. With a timed, motorized machine, the hitter or coach must turn off the machine each time to talk. Last, most coaches will tell a hitter to shift his weight back before the swing. Current machines have no provisions to correct or improve this skill. What is needed is a soft toss pitching machine which is user friendly and provides the same flexibility as having a coach toss the baseball.

It is an object of the present invention to provide soft toss pitching machine which is user friendly and provides the same flexibility as having a coach toss the baseball.

SUMMARY OF INVENTION

A pitching machine that includes a support frame, a ball tube assembly adapted to store and launch the ball. The ball tube assembly is multi-curved and configure such that the ball rolls in the ball tube assembly due to gravity towards a ball rest end for launching. The pitching machine includes a release assembly positioned along the ball tube assembly, the release assembly configured to release the ball from a storage position to a firing position. The pitching machine includes a ball firing assembly positioned beyond the release assembly and along the ball tube assembly, the ball firing assembly configured to launch the ball after being released by the release assembly. The pitching machine includes a control unit adapted to be used by the hitter, the control unit connected to the release assembly and the ball firing assembly to activate the release assembly and the ball firing assembly.

DETAILED DESCRIPTION

The present invention is a soft toss pitching machine, as shown in FIGS. 1–14. The soft toss pitching machine allows one person to practice hitting baseballs without requiring any battery or electrical power. The hitter pushes down on a pedal with the hitter"s forward foot. A ball is then launched into the hitter"s strike zone, where the hitter swings at the launched ball. The soft toss pitching machine allows the hitter to control when the hitter gets a ball pitched to the hitter. Because soft-toss is a practice drill, often a coach will be present to offer guidance and instruction. With the soft toss pitching machine, the hitter has full control of when the next ball will be launched without having to turn anything off. The height and angle of the ball can be adjusted, which allows for pitches to be thrown anywhere from high or low inside to high or low outside the strike zone. The soft toss pitching machine allows for proper positioning so that the hitter shifts his weight back before swinging. The soft toss pitching machine uses real baseballs or softballs. Using real balls allows a hitter to know the hitter is swinging properly, or if the hitter is not making solid contact with the ball. The soft toss pitching machine allows a coach to stand back and observe while the hitter swings. Often-when there is one hitter and one coach, the coach is tossing balls and cannot see the swing dynamics of the hitter.

Figure 1:
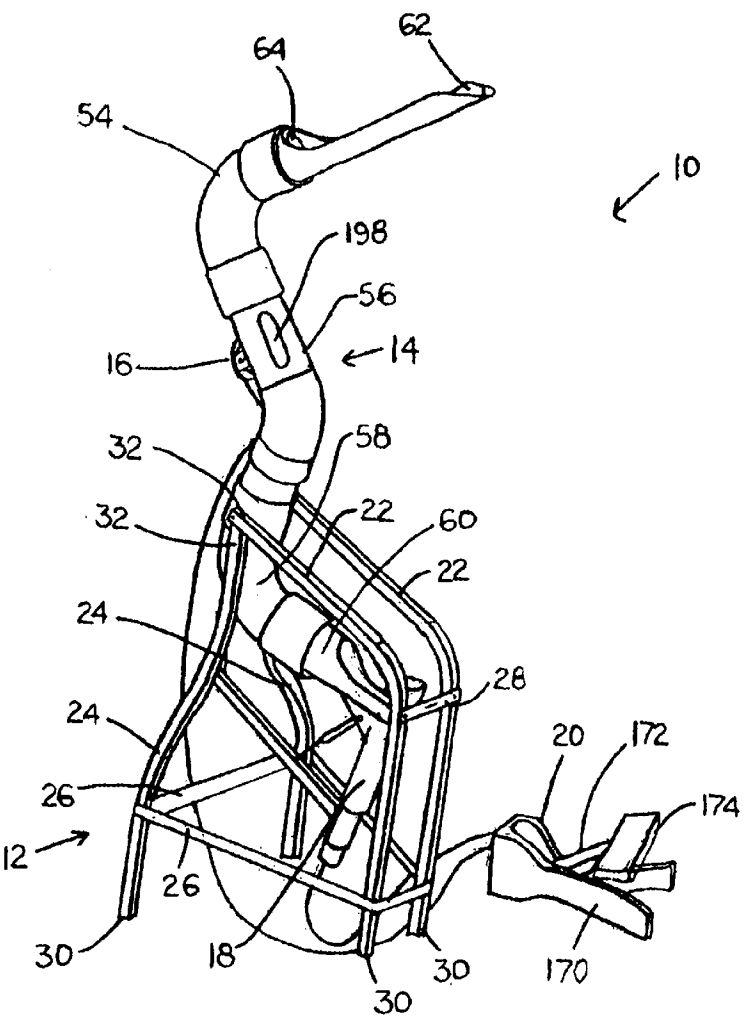
FIG. 1 is a perspective view of a soft toss pitching machine according to the present invention.
Figure 2:
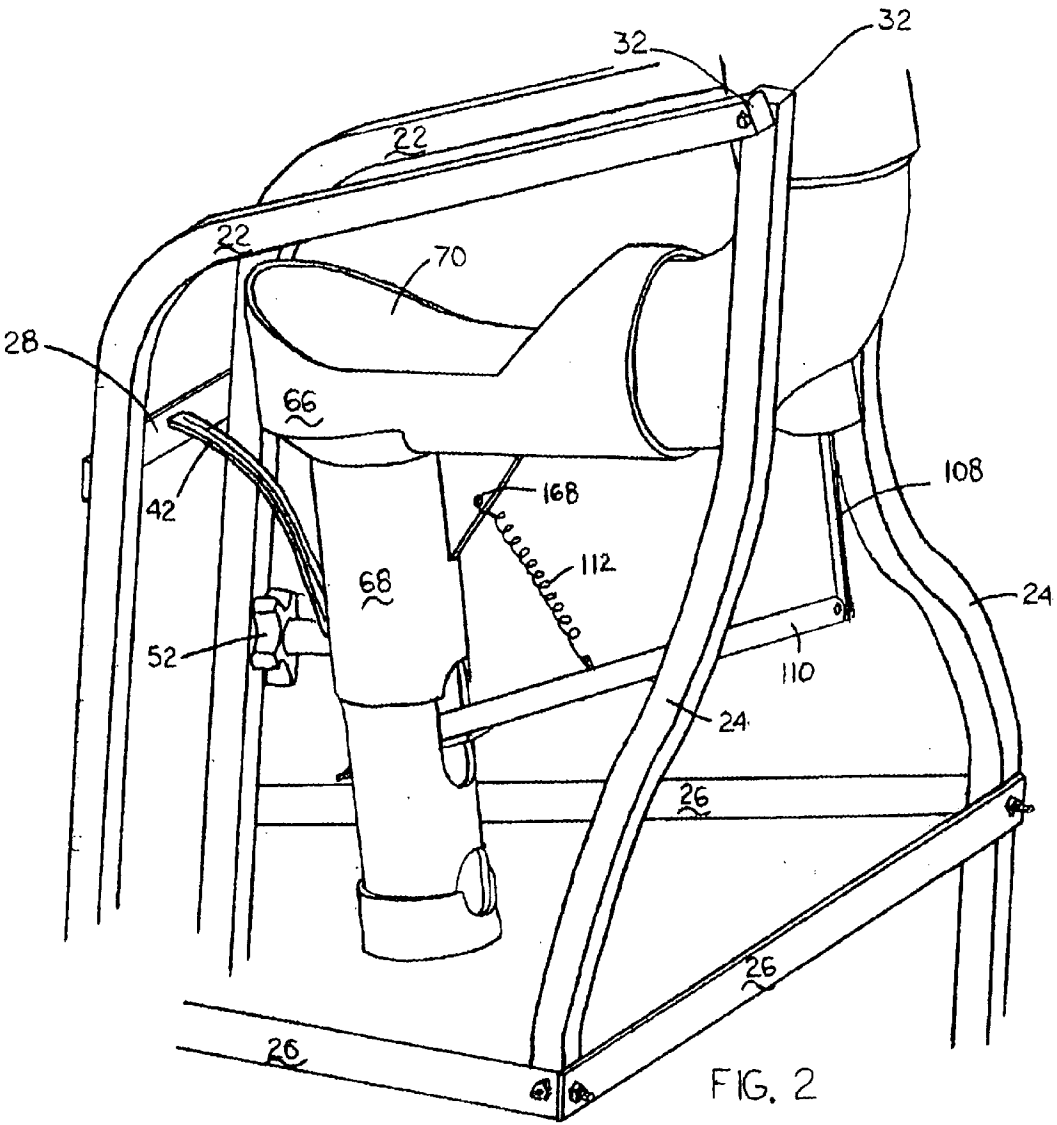
FIG. 2 is a perspective view of a soft toss pitching machine according to the present invention.
Figure 3:
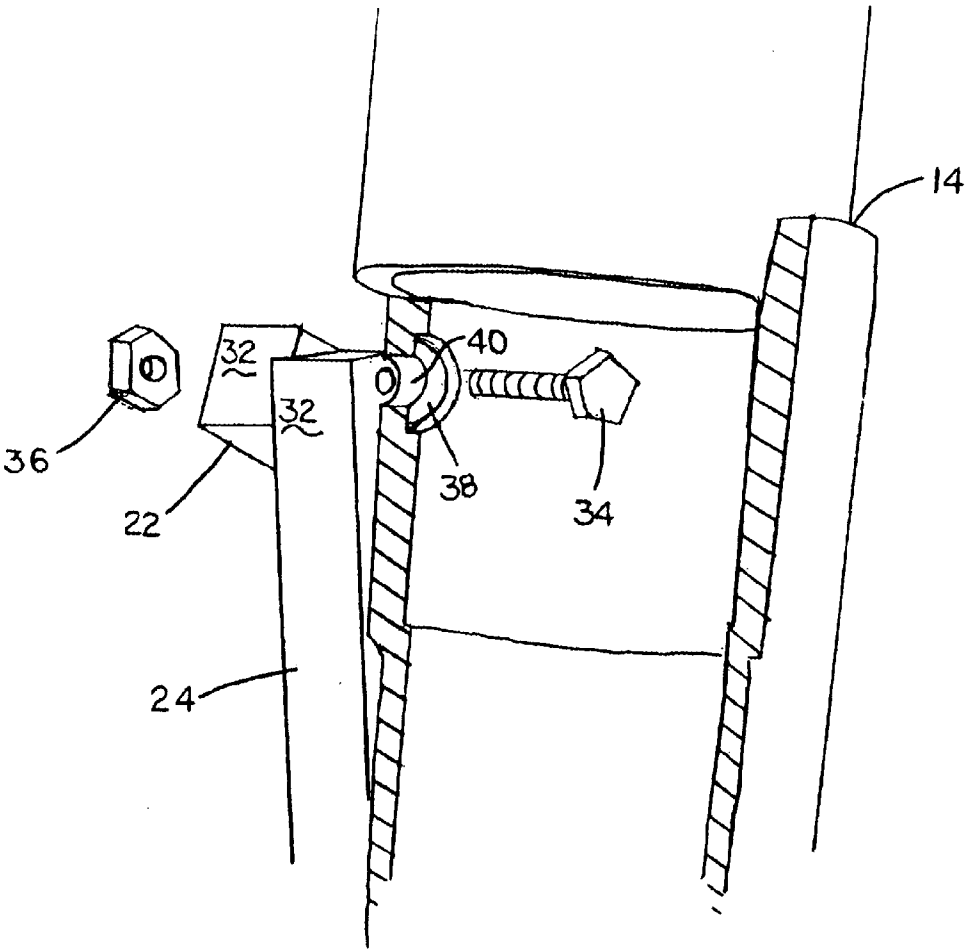
FIG. 3 is an exploded cross sectional view of pivot mounting of a ball tube assembly according to the present invention.
Figure 4:
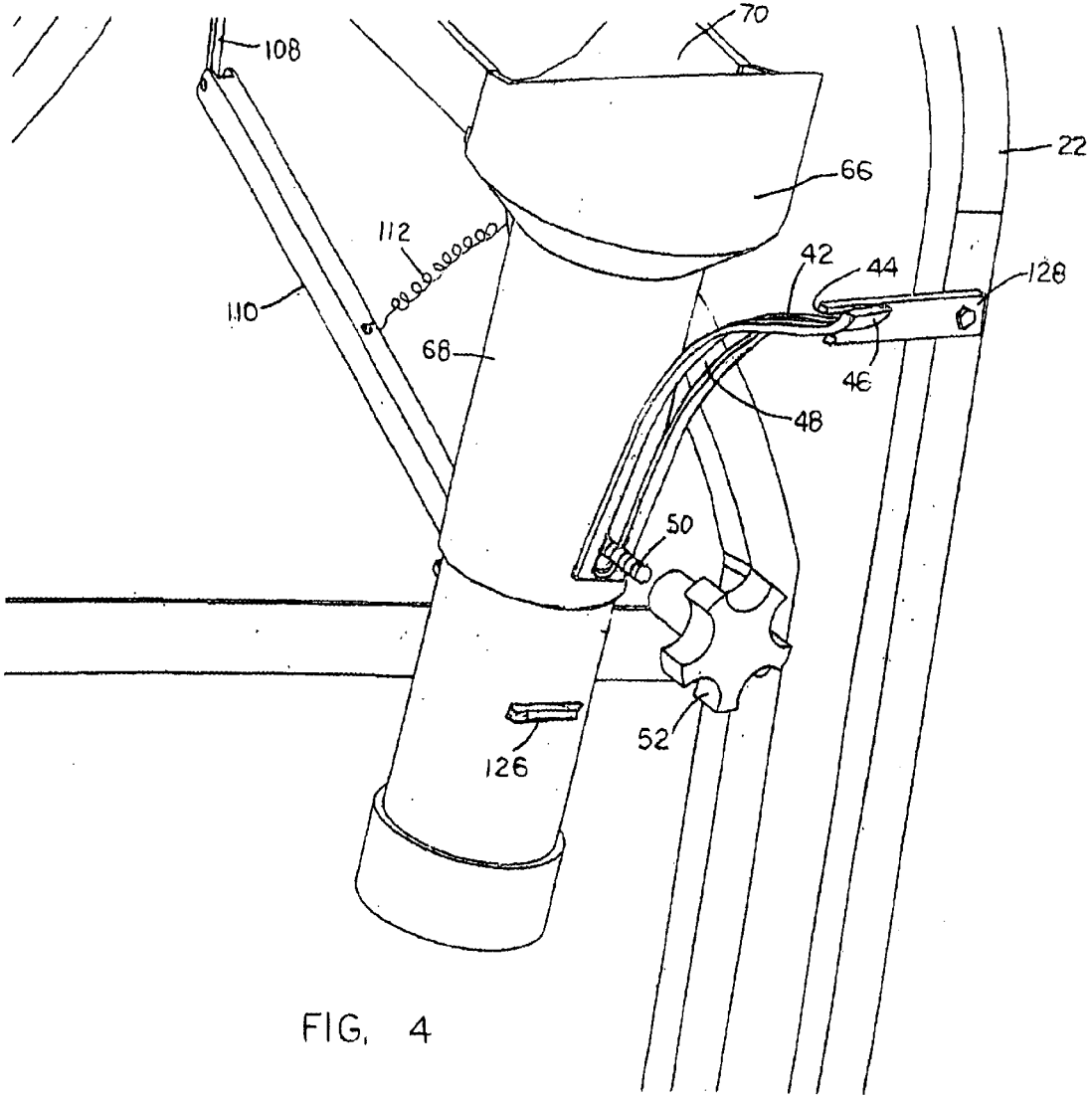
FIG. 4 is a perspective view of a soft toss pitching machine according to the present invention.

FIG. 1 show the soft toss pitching machine 10, which includes a support frame 12, ball tube assembly 14, ball release assembly 16, ball firing assembly 18 and a foot pedal assembly 20. The support frame 12 includes two front legs 22, two rear legs 24, two lower cross members 26 and an attachment cross member 28, as shown in FIGS. 1–2. The two front legs 22 and two rear legs 24 each have a foot end 30 and a pivot end 32. The foot end 30 of each of the legs 22, 24 provides support from the surface where the soft toss pitching machine 10 is at rest. The pivot end 32 of each leg 22, 24 is a connection point for the front legs 22 to the rear legs 24. FIGS. 1–2 show two sets of one front leg 22 connected to one rear leg 24 at the connection point. FIG. 3 shows the pivot end 32 of each leg 22, 24 with a bolt hole. FIG. 3 shows a bolt 34 and nut 36 used to fasten the front and rear legs 22, 24 together. The legs 22, 24 are further secured together to form the support frame 12 by the two lower cross members 26 and the attachment cross member 28. FIGS. 1–2 show the ball tube assembly 14 attached at two points along the support frame 12. The first point is at the connection point as shown in FIG. 3, whereby the bolts 34 are first inserted into a recess bolt cavity 38 of the ball tube assembly 14, which leads to a bolt hole 40. This first point not only acts as a connection point for the ball tube assembly 14, but also as a pivot point for the ball tube assembly 14. The second point is at the attachment cross member 28, as shown in FIGS. 2 and 4. The attachment cross member 28 includes an adjustment brace 42. The adjustment brace 42 extends from a brace slot 44 in the attachment cross member 28 and attaches to the ball tube assembly 14. The adjustment brace 42 includes an angled end 46 and adjustment slot 48. The angled end 46 is slipped into the brace slot 44 and retained in the brace slot 44 due to the angle shape of the angled end 46. The ball tube assembly 14 is attached to the adjustment brace 42 at the adjustment slot 48. The ball tube assembly 14 includes a threaded stud 50 extending outward and which is inserted into the adjustment slot 48. An adjustment knob 52 screws onto the threaded stud 52 to secure the ball tube assembly 14 to the adjustment brace 42.

Figure 10:
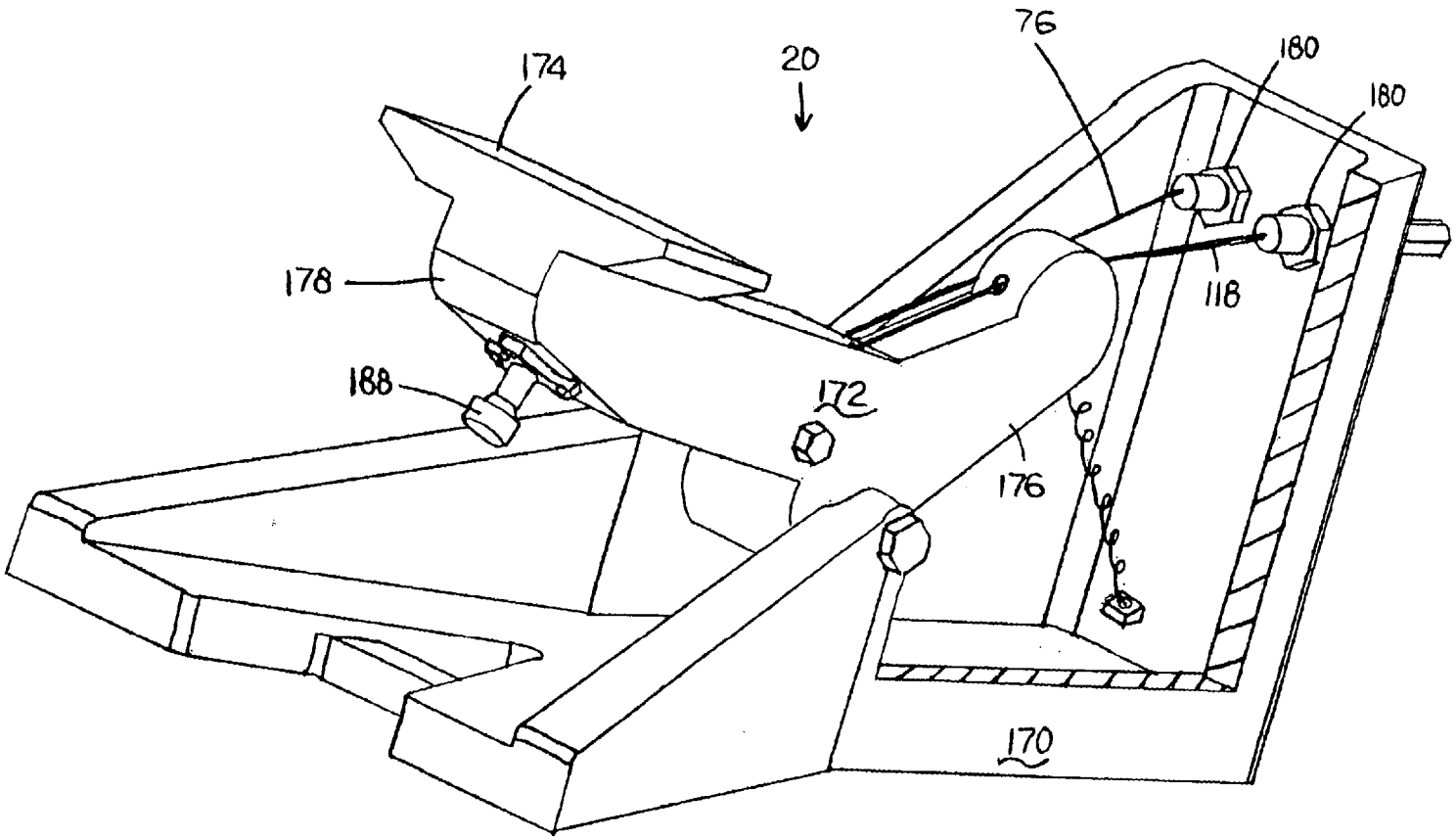
FIG. 10 is a perspective cross sectional view of a pedal assembly according to the present invention.
Figure 11:
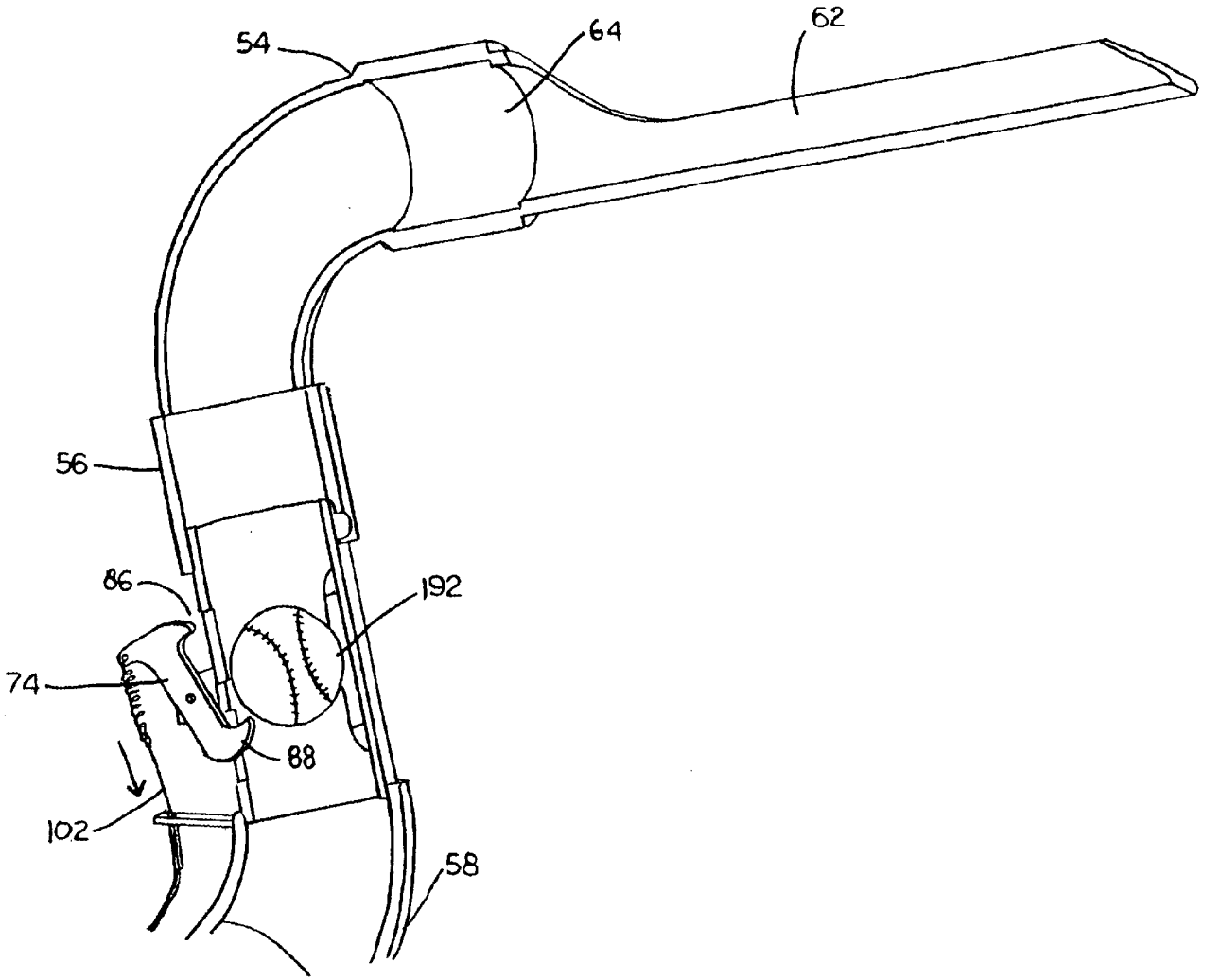
FIG. 11 is a cross sectional view of operation of a soft toss pitching machine according to the present invention.
Figure 12:
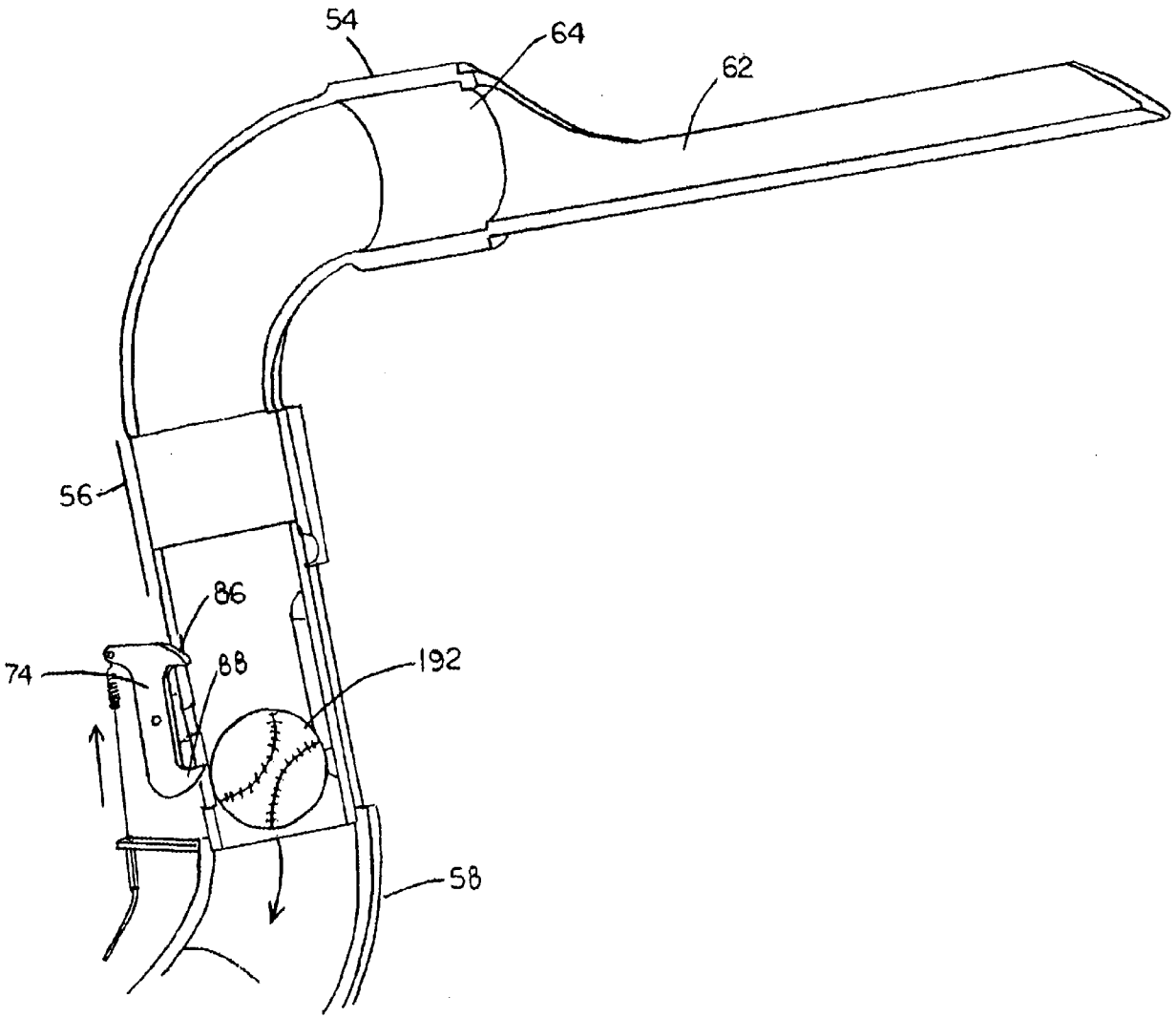
FIG. 12 is a cross sectional view of operation of a soft toss pitching machine according to the present invention.
Figure 13:
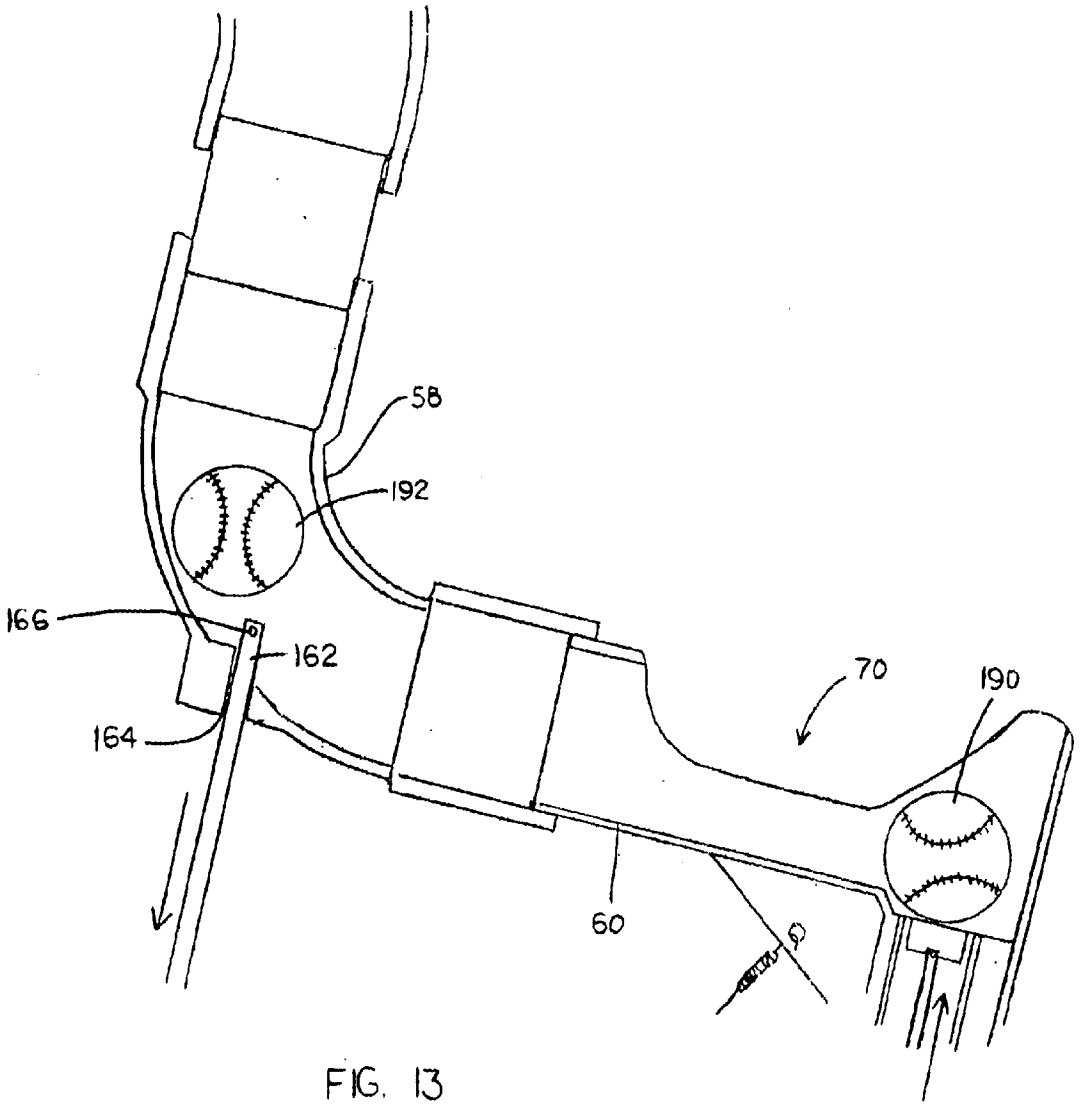
FIG. 13 is a cross sectional view of operation of a soft toss pitching machine according to the present invention.
Figure 14:
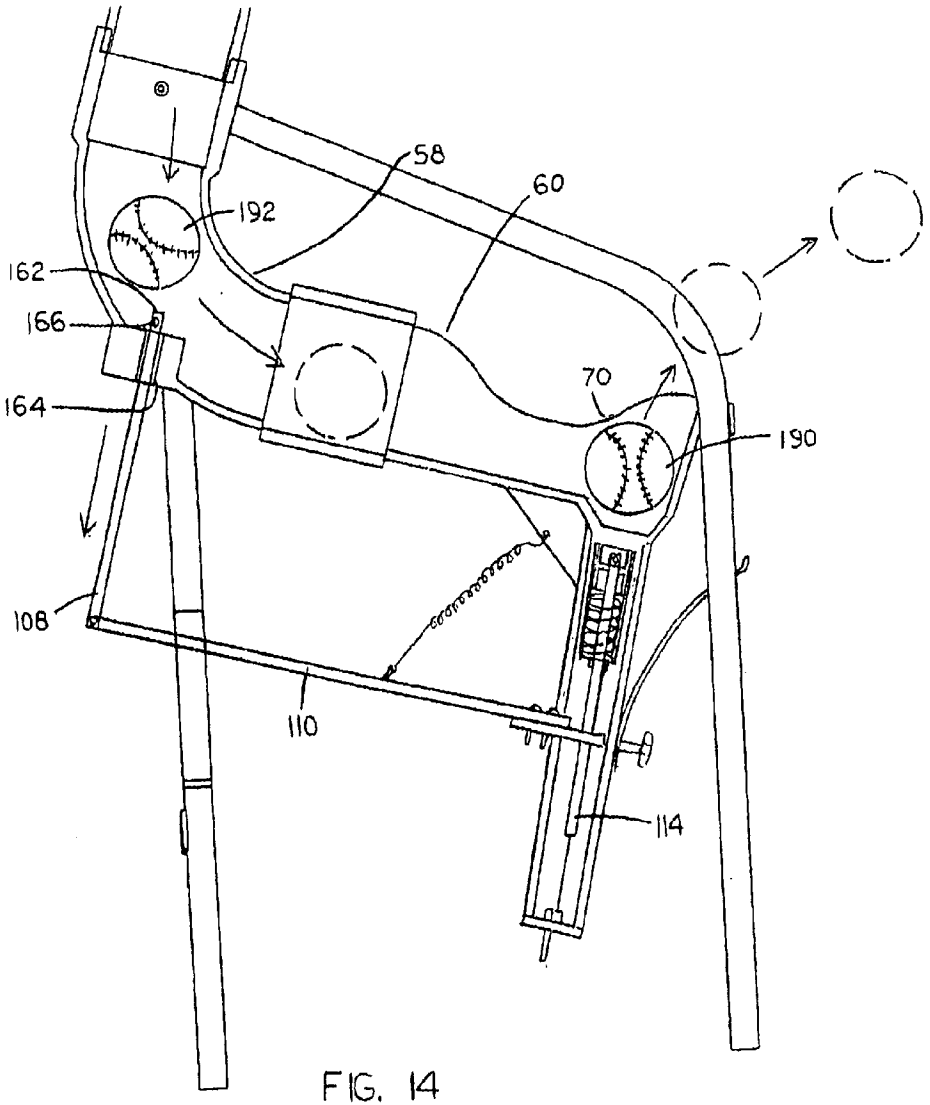
FIG. 14 is a cross sectional view of operation of a soft toss pitching machine according to the present invention.

The ball tube assembly 14 is a multi-curved tube with an inner open path at least as large as the ball that is to be used in the ball tube assembly 14, as shown in FIGS. 1–8 and 10–13. The inner open path is always leading in a downward direction, so that the ball rolls due to gravity along the inner open path. The ball tube assembly 14 includes a loading section 54, release section 56, activation section 58 and firing section 60. All of the sections 54, 56, 58, 60 include the inner open path. The loading section 54 includes an open storage area 62 which leads to a load opening 64. The load opening 64 leads to the inner open path along the remaining sections 56, 58, 60 of the ball tube assembly 14. The open storage area 62 of the loading section 54 tilts downward, so as balls are loaded, the balls roll into the load opening 64. From the load opening 64, the loading section 54 curves downward and connects to the release section 56 of the ball tube assembly 14. The release section 56 leads in a downward direction to the activation section 58, as shown in FIGS. 11–12. FIGS. 13–14 show the internal view of the activation section 58. The activation section 58 curves about ninety degrees and leads to the firing section 60. The firing section 60 includes a ball rest end 66. The firing section 60 includes a firing housing 68 attached below the ball rest end 66, which includes the threaded stud 50. The firing section 60 includes a firing opening 70 at the ball rest end 66, as shown in FIGS. 13–14.

Figure 5:
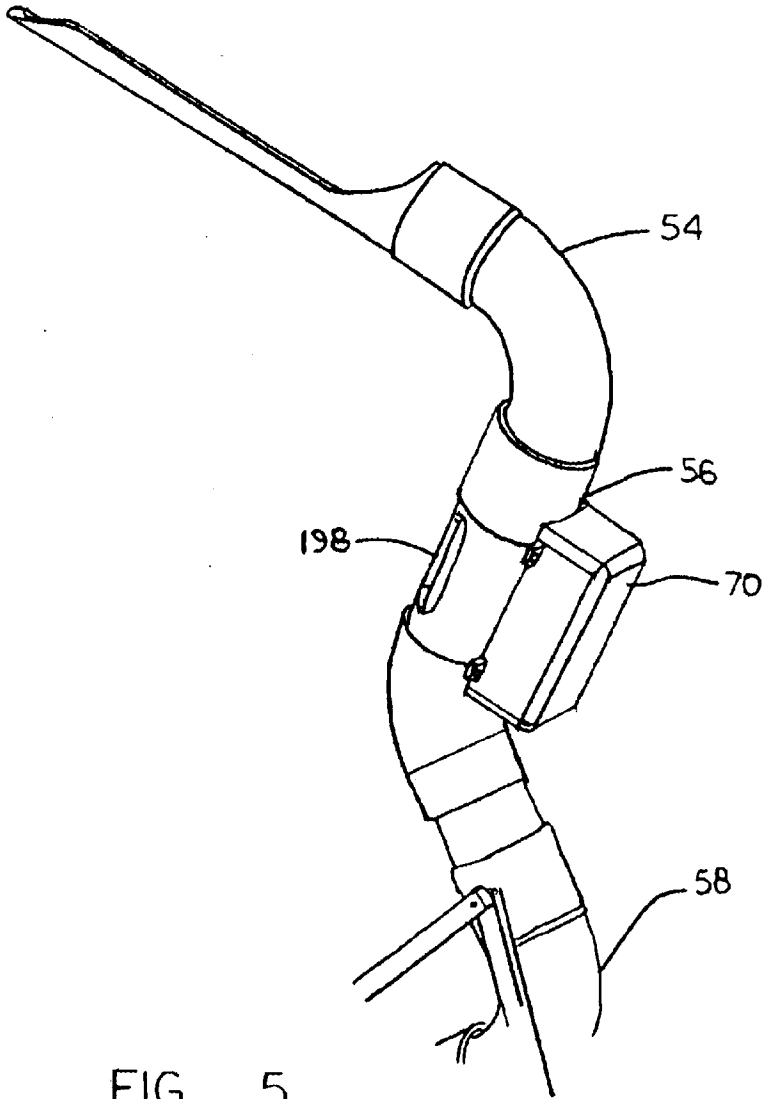
FIG. 5 is a perspective view of a soft toss pitching machine according to the present invention.
Figure 6:
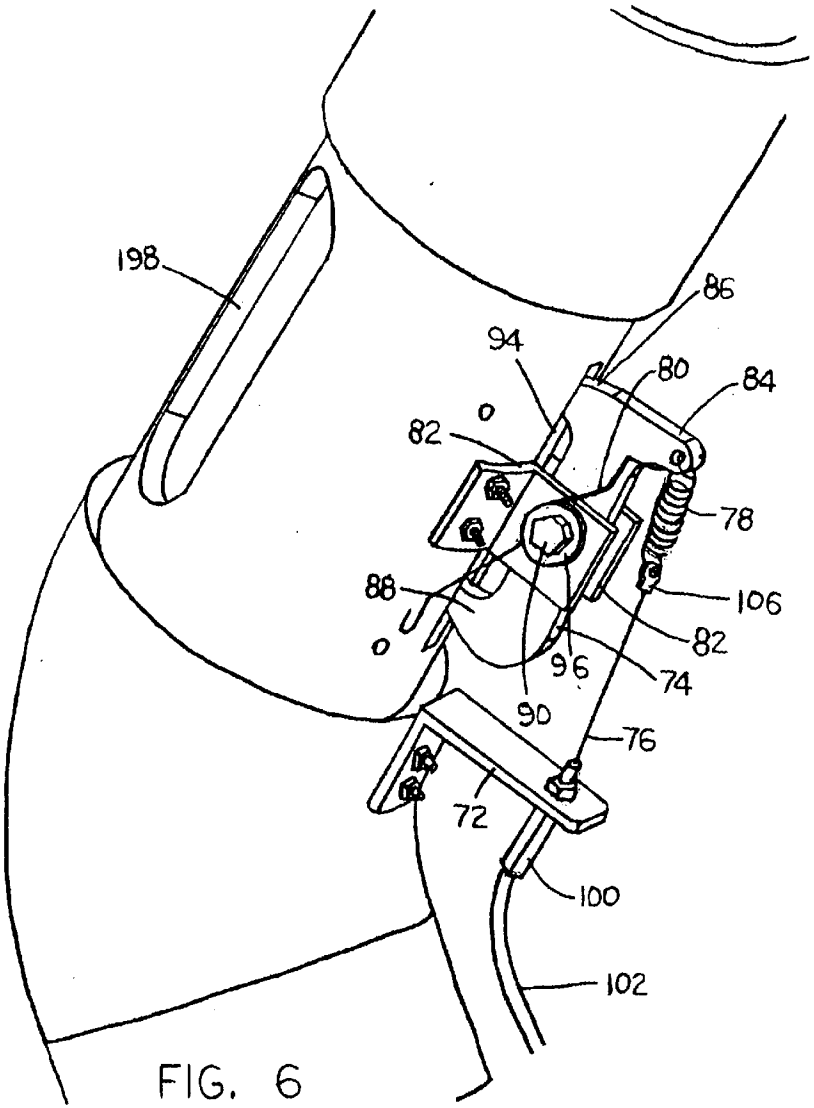
FIG. 6 is a perspective view of a release assembly according to the present invention.
Figure 7:
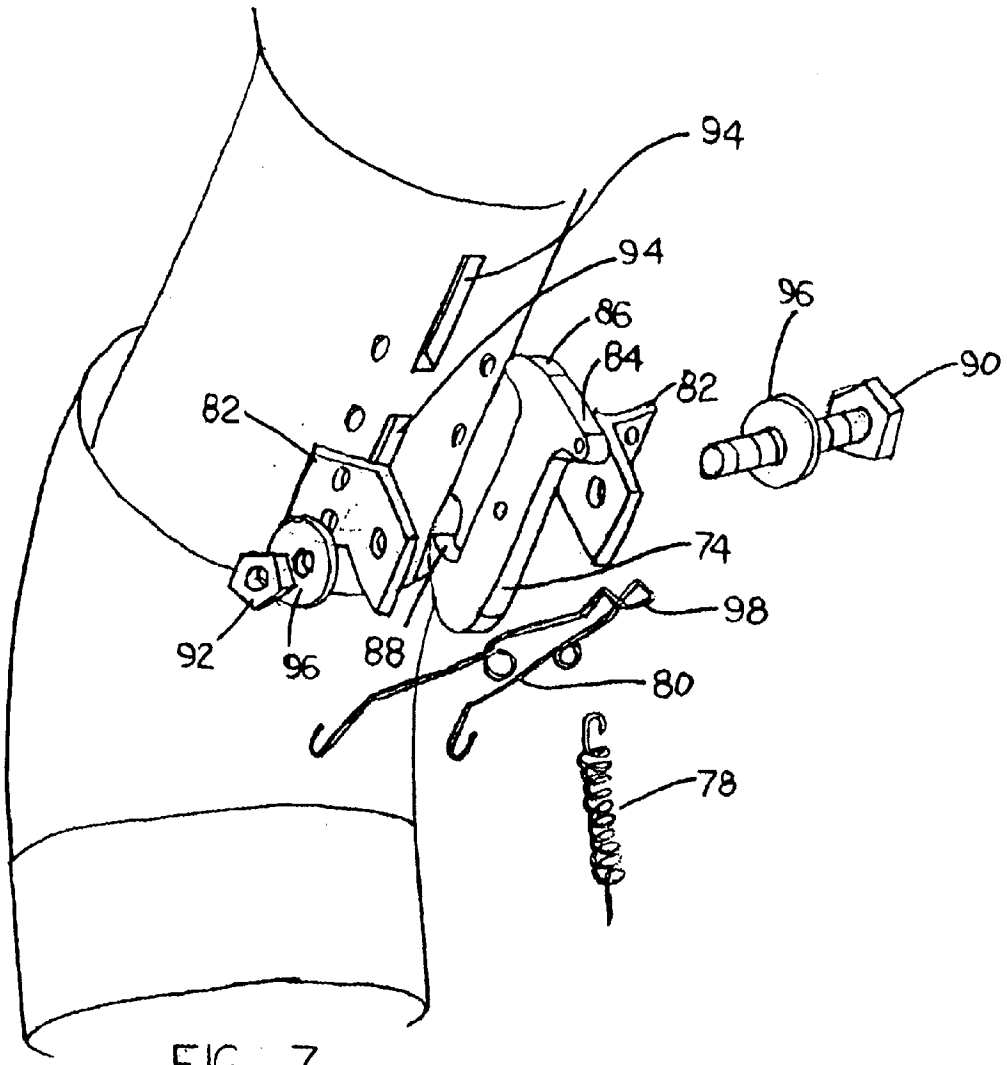
FIG. 7 is an exploded perspective view of a release assembly according to the present invention.

The ball release assembly 16 is shown in FIGS. 6–7. FIG. 5 shows a cover 71 as part of the ball release assembly 16 that is attached to the release section 56 of the ball tube assembly 14. The ball release assembly 16 includes a release cable bracket 72, release arm 74, release cable 76, release cable spring 78, release arm spring 80 and two release arm brackets 82. The release arm brackets 82 mount to the release section 56 of the ball tube assembly 14. The release arm brackets 82 are mounted to leave enough space to receive the release arm 74 between the release arm brackets 82. The release arm 74 includes a spring catch 84, first ball stop 86 and second ball stop 88. The release arm 74 is rotationally mounted to the release arm brackets 82 at about the mid point of the release arm 74 with an arm bolt 90 and arm nut 92. The release section 56 of the ball tube assembly 14 includes a release arm slot 94 to allow the ball stops 86, 88 of the release arm 74 to enter the inner open path of the release section 56. The release arm spring 80 is a double torsion spring which is retained by the arm bolt 90 and washers 96. The torsion spring arm 98 of the release arm spring 80 is biased against the spring catch 84 to bias the first ball stop 86 into the release arm slot 94. The release cable bracket 72 is mounted to the release section 56 of the ball tube assembly 14 and below the release arm brackets 82. The release cable bracket 72 is for mounting of a first end 100 of a release cable guide 102 which contains the release cable 76. The release cable 76 includes a first end 106 connected to the release cable spring 78 and the release cable spring 78 is connected to a hole in the spring catch 84.

Figure 8:
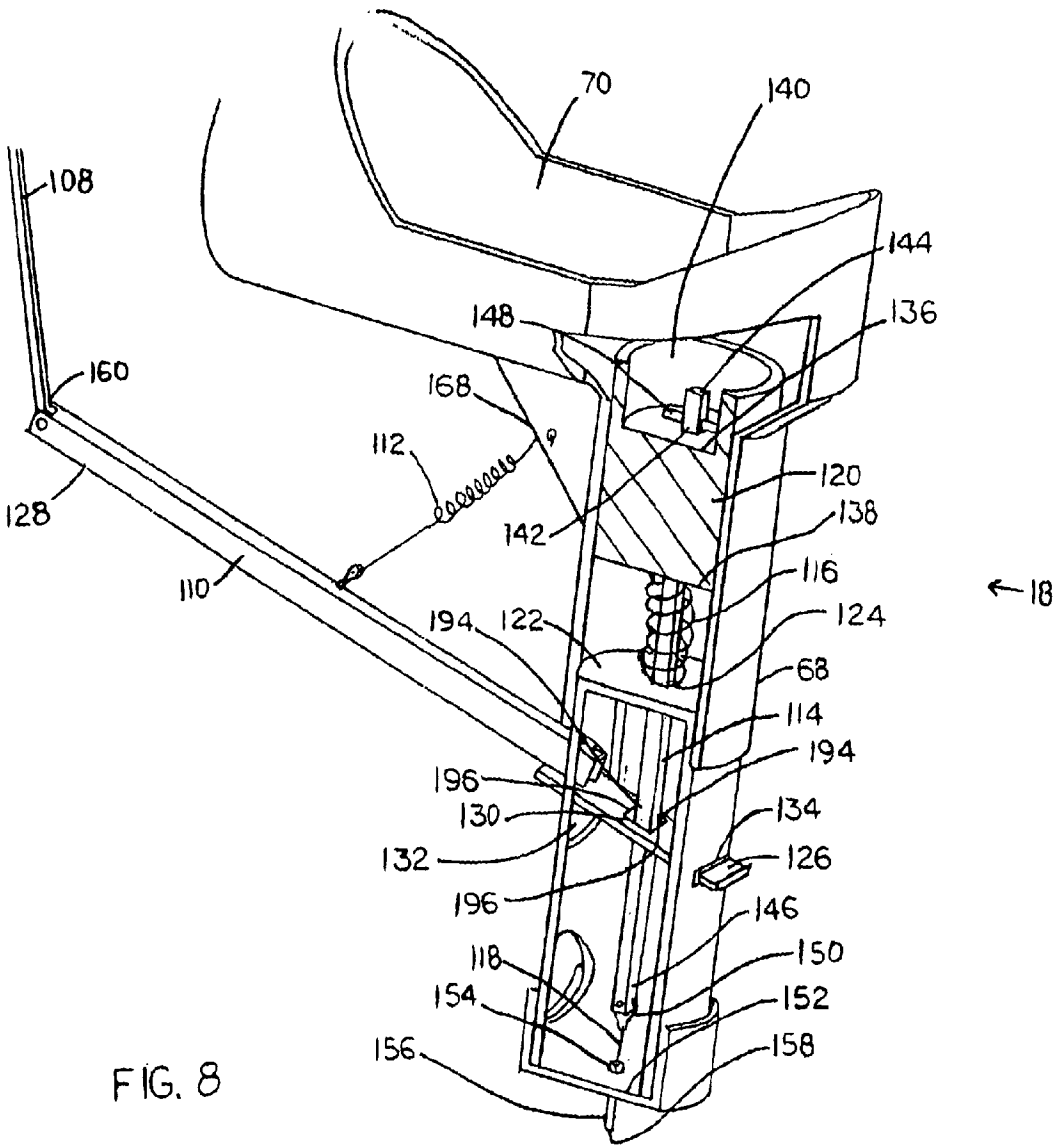
FIG. 8 is a cross sectional view of a firing assembly according to the present invention.

The ball firing assembly 18 is shown in FIG. 8. The ball firing assembly 18 includes an activation rod 108, activation arm 110, activation return spring 112, firing rod 114, firing spring 116, firing cable 118 and firing cup 120. The firing housing 68 includes a cup stop 122 with a square hole 124. The activation arm 110 includes a firing rod end 126 and an activation arm end 128. The firing rod end 126 of the activation arm 110 includes a square hole 130. The firing housing 68 includes an activation opening 132 to allow the firing rod end 126 of the activation arm 110 to be inserted into the firing housing 68. Opposite the activation opening 132 is a firing rod end slot 134 to receive the firing rod end 126. The firing cup 120 includes a top 136 and a bottom 138. The top 136 of the firing cup 120 includes a cavity 140 to form a ball cup to receive a ball. The firing cup 120 includes a square hole 142 from the top 136 to the bottom 138 of the firing cup 120. The firing rod 114 is square and includes a top end 144 and a bottom end 146. The top end 144 of the firing rod 114 includes a cross member 148 extending from two opposite sides of the square shaped firing rod 114. The firing rod 114 is inserted bottom end first into the square hole 142 at the top 136 of the firing cup 120. The firing spring 116 is a compression spring that is slipped over the bottom end 146 of the firing rod 114 and below the firing cup 120. Next, the bottom end 146 of the firing rod 114 is inserted into the square hole 124 of cup stop 122 in the firing housing 68. Then, the bottom end 146 of the firing rod 114 is inserted into the square hole 130 of the firing rod end 126 of the activation arm 110. Finally, the bottom end 146 of the firing rod 114 is connected to a first end 150 of the firing cable 118. The bottom of the firing housing 68 includes a bottom plate 152 with a cable hole 154 for attachment of a first end 156 of a firing cable guide 158, which shields the firing cable 118. The activation arm end 128 of the activation arm 110 is rotatably attached to a bottom end 160 of the activation rod 108. A top end 162 of the activation rod 108 is inserted into an activation rod opening 164 in the bottom of the outside surface of the activation section 58 of the ball tube assembly 14. The activation rod opening 164 leads to the inner open path in the activation section 58 at the change in direction of the inner open path. This allows the activation rod 108 to protrude into the inner open path. The top end 162 of the activation rod 108 is shown with an activation rod cross member 166 to prevent the activation rod 108 from falling out of the ball tube assembly 14. The activation rod cross member 166 can be as simple as a roll pin that is inserted into a hole in the top end 162 of the activation rod 108, which is also true for the cross member of the firing rod 114. Activation return spring 112 is a tension spring mounted between a point at about the mid point of the activation arm 110 and a point 168 above the activation arm 110 on the ball tube assembly 14. FIG. 8 shows the point 168 on the ball tube assembly 14 being a gusset between the firing section 60 and the firing housing 68 of the ball tube assembly 14.

Figure 9:
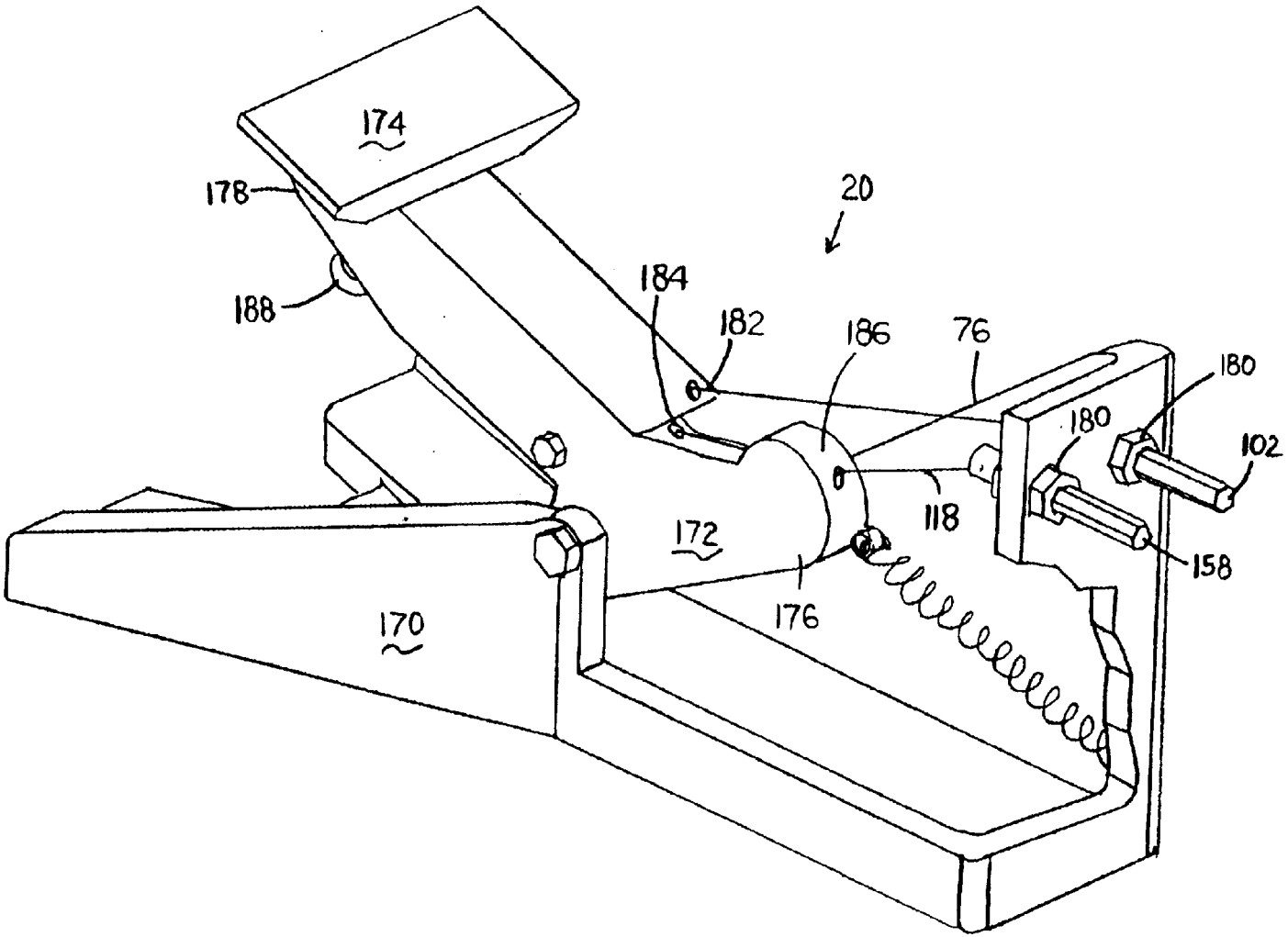
FIG. 9 is a perspective cross sectional view of a pedal assembly according to the present invention.

FIGS. 9–10 show the foot pedal assembly 20, which acts as a control unit. The foot pedal assembly 20 includes a base 170, pedal arm 172 and a pedal 174. The pedal arm 172 includes a cable end 176 and pedal end 178. The pedal arm 172 is rotatably attached to the base 170 at a point on the pedal arm 174 which is between the cable end 176 and the pedal end 178. The pedal 174 is attached to the pedal end 178 of the pedal arm 172. The release cable guide 102 and the firing cable guide 158 each have a second end 180 connected to the base of the foot pedal assembly 20. The release cable 76 has a second end 182 extending from the second end 180 of the release cable guide 102 and connected to the cable end 176 of the pedal arm 172. The firing cable 118 has a second end 184 extending from the second end 180 of the firing cable guide 118 and connected to the cable end 176 of the pedal arm 172. The pedal arm 172 includes a firing cable pedal guide 186 as part of the pedal arm 172. The firing cable pedal guide 186 acts as a fulcrum which applies more pulling pressure on the firing cable 118 during movement of the pedal arm 172. The pedal arm 172 includes an adjustable pedal stop 188 on the bottom of the pedal end 178 of the pedal arm 172. The adjustable pedal stop 188 screws in and out of the bottom of the pedal arm 172.

The soft toss pitching machine 10 is operated as follows and as shown in FIGS. 11–14. A ball 190 is loaded into the firing cup 120 at the ball rest end 66 of the firing section 60 of the ball tube assembly 14. Balls are loaded into the open storage area 62 of the loading section 54. The balls will roll down the inner open path into the release section 56, whereby the first loaded ball 192 into the open storage area 62 will stop at the first ball stop 86 of the release arm 74. The first loaded ball 192 into the open storage area 62 is considered the second ball 192. Balls will continue to stack up until the open storage area 62 of the loading section 54 is full. The hitter positions himself in front of the soft toss pitching machine 10 and uses the forward foot to push down on the pedal 0.174, which pushes down the pedal end 178 of the pedal arm 172. The pedal arm 172 simultaneously pulls on the release cable 76 and the firing cable 118. Pulling on the release cable 76 at the second end 180 causes the first end 106 of the, release cable 76 to pull and rotate the release arm 74, such that the first ball stop 86 exits from the inner open path, as shown in FIG. 11. When the first ball stop 86 exits from the inner open path, the second ball 192 rolls down and engages the second ball stop 88 of the release arm 74 that has rotated into the inner open path. At the same time, pulling on the firing cable 118 at the second end 184 causes the first end 150 of the firing cable 118 to pull the firing rod 114 downward. Pulling of the firing rod 114 downward, pulls down the firing cup 120 and compresses the firing spring 116 in the firing housing 68. The firing rod end 126 of the activation arm 110 is shown as a flat piece inserted in the firing rod end slot 134. This allows the activation arm 110 to pivot up and down at the firing rod end slot 134. When the firing rod 114 is pulled down, the firing rod 114 and firing rod end 126 of the activation arm 110 bind together. The firing rod 114 and firing rod end 126 of the activation arm 110 bind together due to the frictional forces between front and rear surfaces 194 of the square firing rod 114 that engage front and rear surfaces 196 outlining the square hole 130 of the firing rod end 126. The front and rear surfaces 194 of the firing rod 114 engage the front and rear surfaces 196 outlining the square hole 130 of the firing rod end 126 due to the activation arm 110 being pulled at an angle to the firing rod 114 by the activation return spring 112. The binding of the firing rod 114 and firing rod end 126 of the activation arm 110 holds the compressed firing spring 116 and firing cup 120 in a lowered position. The firing cable pedal guide 186 on the pedal arm 172 lowers the amount of pressure which is needed to be applied by the hitter to pull down the firing rod 114 and compress the firing spring 116.

When the hitter releases the pedal 174, the firing spring 116 remains compressed due to binding between on the firing rod 114 and firing rod end 126 of the activation arm 110. Also, when the hitter releases the pedal 174, the release arm spring 80 biases the release arm 74 to rotate such that the second ball stop 88 exits from the inner open path and the first ball stop 86 enters the inner open path. When the second ball stop 88 exits the inner open path, the second ball 192 falls down the remaining portion of the release section 56 and into the activation section 58 of the ball tube assembly 14 along the inner open path. At the same time, the first ball stop 86 engages the next ball (not shown) above the second ball 192 and prevents the next ball from moving beyond the first ball stop 86. The second ball 192 falls downward toward the top end 162 of the activation rod 108. There is a time delay created due to the falling of the second ball 192 toward the top end 162 of the activation rod 108. This time delay is dependant on the distance from the second ball stop 88 to the top end 162 of the activation rod 108. Once the second ball 192 hits the top end 162 of the activation rod 108, the activation rod 108 is forced downward and the second ball 192 rolls past the top end 162 of the activation rod 108 and onto the firing section 60 along the inner open path. Movement of the activation rod 108 downward forces the activation end 128 of the activation arm 110 downward. Movement of the activation end 128 of the activation arm 110 downward releases the binding forces between the firing rod 114 and firing rod end 126 of the activation arm 110 and releases the firing rod 114. Release of the firing rod 114 allows the firing spring 116 to force the firing cup 120 upward and launch the first ball 190 in the firing cup 120 up into the air for the hitter to swing and try to hit the launched ball. After this, the activation return spring 112 pulls the activation end 128 of the activation arm 110 upward. Movement of the activation arm 110 upward, forces the activation rod 108 to rise and the top end 162 of the activation rod 108 to protrude into the activation section 58. Thereby, finalizing a reset of the soft toss pitching machine 10. The second ball 19.2 rolls into the firing cup 120 and the next ball that was above the second ball 192 is ready to be release the next time the hitter depresses the pedal 174.

The angle that a ball is launched by the firing cup 120 can be set by raising or lowering the firing section 60 of the ball tube assembly 14. The firing section 60 of the ball tube assembly 14 is raised or lowered by rotating the ball tube assembly 14 about the first point of connection of the ball tube assembly 14 to the support frame 12. The ball tube assembly 14 is unsecured or secured in position by use of the adjustment knob 52 with the threaded stud 50 and the adjustment brace 42. The height a ball is launch can be adjusted by increasing or decreasing the depth of depression of pedal 174 of the foot pedal assembly 20. This allows for the soft toss pitching machine 10 to simulate high or low inside to high or low outside pitches in the strike zone. The adjustment of the depth of depression of the pedal 174 is controlled by the adjustable pedal stop 188 on the bottom of the pedal end 178 of the pedal arm 172. Some hitters, especially young hitters, get into a habit of lunging forward when swinging a bat. This habit reduces power in the swing. Coaches will tell their hitters to shift the weight back and be light on the hitter"s front foot. The soft toss pitching machine 10 encourages the hitter to do this because the hitter has to shift the hitter"s weight back as the hitter returns to a hitting position from pressing the pedal 174 with the hitter"s front foot. The release cable spring 78 allows for self adjustment of the length of the release cable 76 based on the adjustment of the adjustable pedal stop 188. The rounded shape of the first ball stop 86 and the second ball stop 88 aids in promoting the naturally rolling of a ball along the inner open path. Finally, the ball tube assembly 14 includes access holes 198 along the ball tube assembly 14 to allow assembly and maintenance of the soft toss pitching machine 10.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A pitching machine, for launching a ball to simulate a soft toss pitch which can be activated by a hitter, comprising:

a support frame;

a ball tube assembly adapted to store and launch the ball, said ball tube assembly being multi-curved and said ball tube assembly being configure such that the ball rolls in said ball tube assembly due to gravity towards a ball rest end for launching;

a release assembly positioned along said ball tube assembly, said release assembly configured to release the ball from a storage position to a firing position;

a ball firing assembly positioned beyond said release assembly and along said ball tube assembly, said ball firing assembly configured to launch the ball after being released by said release assembly; and a control unit adapted to be used by the hitter, said control unit connected to said release assembly and said ball firing assembly to activate said release assembly and said ball firing assembly.

2. The pitching machine of claim 1, wherein said ball tube assembly is pivotally connected to said support frame to adjust: ball launch angle.

3. The pitching machine of claim 1, wherein said ball tube assembly includes a loading section, release section, activation section and firing section; wherein said loading section is connected to said release section and includes an open storage area to load and store balls and direct balls to said release section; wherein said release section is connected to said activation section and includes positioning of said release assembly; wherein said activation section is connected to said firing section; wherein said firing section includes positioning of said ball firing assembly; wherein said loading section, release section, activation section and firing section each including an inner open path, such that the ball can travel from said loading section to said firing section.

4. The pitching machine of claim 3, wherein said open storage area includes a load opening which leads to the inner open path along said release section, activation section and firing section; wherein said open storage area of said loading section tilts downward, so as balls are loaded, the balls roll into the load opening; wherein from said load opening said loading section curves downward and connects to said release section; wherein said release section leads in a downward direction to said activation section; wherein said activation section curves about ninety degrees and leads to said firing section; and wherein said firing section includes said ball rest end.

5. The pitching machine of claim 4, wherein said release assembly includes a first ball stop which can be moved into said inner open path of said release section and a second ball stop which can be moved into said inner open path of said release section.

6. The pitching machine of claim 4, wherein said ball release assembly includes a release arm; wherein said release arm includes a first end and a second end; wherein said release arm pivotally mounts to said release section between said first and second ends; wherein said release arm includes a first ball stop which can be moved into said inner open path of said release section on said first end of said release arm and a second ball stop which can be moved into said inner open path on said second end of said release arm.

7. The pitching machine of claim 4, wherein said ball firing assembly includes a firing housing, firing rod, firing spring, firing cable and firing cup; wherein said firing housing is located at said ball rest end of said ball tube assembly; wherein said firing housing includes a cup stop with a hole; wherein said firing cup includes a top, a bottom, said top of said firing cup includes a cavity to form a ball cup to receive the ball and said firing cup includes a hole from said top to said bottom of said firing cup; wherein said firing rod includes a top end and a bottom end; wherein said top end of said firing rod is interconnected to said firing cup, wherein said firing spring is slipped over said bottom end of said firing rod and below said firing cup; wherein said bottom end of said firing rod is inserted into said hole of said cup stop in said firing housing; and wherein said firing cable is connected between said bottom end of said firing rod and said control unit.

8. The pitching machine of claim 7, wherein said ball firing assembly further includes an activation rod, activation arm and activation return spring; wherein said activation rod includes a top end and a bottom end; wherein said top end of said activation rod protrudes into said activation section of said ball tube assembly such that the ball hits said top end of said activation rod as the ball rolls along said inner open path; wherein activation arm includes a firing rod end and an activation arm end; wherein said firing rod end of said activation arm includes a hole to receive said firing rod; said firing housing includes an activation opening to allow said firing rod end of said activation arm to be inserted into said firing housing; wherein opposite said activation opening said firing rod end of said activation arm is pivotally connected to said firing housing; wherein said activation arm end of said activation arm is rotatably attached to a bottom end of said activation rod; wherein said activation return spring is mounted between a point at about mid point of said activation arm and a point above said activation arm on said ball tube assembly.

9. The pitching machine of claim 8, wherein said holes of said firing cup, said cup stop and said firing rod of said activation rod are square.

10. The pitching machine of claim 8, wherein said ball tube assembly is pivotally connected to said support frame to adjust ball launch angle.

11. The pitching machine of claim 1, wherein said control unit is a foot pedal assembly which includes a base, pedal arm and a pedal; wherein said pedal arm includes a cable end and pedal end and said pedal arm is rotatably attached to said base at a point on said pedal arm which is between said cable end and said pedal end; wherein said pedal is attached to said pedal end of said pedal arm; wherein there is a release cable connected between said release assembly and said pedal arm; wherein there is a firing cable connected between said ball firing assembly and said pedal arm; and wherein said pedal arm includes an adjustable pedal stop on a bottom of said pedal end of said pedal arm.

12. The pitching machine of claim 11, wherein said ball tube assembly is pivotally connected to said support frame to adjust ball launch angle.

13. The pitching machine of claim 1, wherein said release assembly includes a first ball stop which can be moved into said inner open path of said release section and a second ball stop which can be moved into said inner open path of said release section.

14. The pitching machine of claim 1, wherein said ball release assembly includes a release arm; wherein said release arm includes a first end and a second end; wherein said release arm pivotally mounts to said release section between said first and second ends; wherein said release arm includes a first ball stop which can be moved into said inner open path of said release section on said first end of said release arm and a second ball stop which can be moved into said inner open path on said second end of said release arm.

15. The pitching machine of claim 14, wherein said release assembly includes a release spring to bias said release arm such that said first ball stop moves into said inner open path of said release section.

16. The pitching machine of claim 14, wherein said release assembly includes a release cable between said control unit and said release arm to pivot said release arm, such that said first ball stop and said second ball stop can be moved in and out of said inner open path of said release section.

17. The pitching machine of claim 1, wherein said ball firing assembly includes a firing housing, firing rod, firing spring, firing cable and firing cup; wherein said firing housing is located at said ball rest end of said ball tube assembly; wherein said firing housing includes a cup stop with a hole; wherein said firing cup includes a top, a bottom, said top of said firing cup includes a cavity to form a ball cup to receive the ball and said firing cup includes a hole from said top to said bottom of said firing cup; wherein said firing rod includes a top end and a bottom end; wherein said top end of said firing rod is interconnected to said firing cup, wherein said firing spring is slipped over said bottom end of said firing rod and below said firing cup; wherein said bottom end of said firing rod is inserted into said hole of said cup stop in said firing housing; and wherein said firing cable is connected between said bottom end of said firing rod and said control unit.

18. The pitching machine of claim 17, wherein said ball firing assembly further includes an activation rod, activation arm and activation return spring; wherein said activation rod includes a top end and a bottom end; wherein said top end of said activation rod protrudes into said activation section of said ball tube assembly such that the ball hits said top end of said activation rod as the ball rolls along said inner open path; wherein activation arm includes a firing rod end and an activation arm end; wherein said firing rod end of said activation arm includes a hole to receive said firing rod; said firing housing includes an activation opening to allow said firing rod end of said activation arm to be inserted into said firing housing; wherein opposite said activation opening said firing rod end of said activation arm is pivotally connected to said firing housing; wherein said activation arm end of said activation arm is rotatably attached to a bottom end of said activation rod; wherein said activation return spring is mounted between a point at about mid point of said activation arm and a point above said activation arm on said ball tube assembly.

19. The pitching machine of claim 18, wherein said holes of said firing cup, said cup stop and said firing rod of said activation rod are square.

20. The pitching machine of claim 1, wherein said control unit is a foot pedal assembly which includes a base, pedal arm and a pedal; wherein said pedal arm includes a cable end and pedal end and said pedal arm is rotatably attached to said base at a point on said pedal arm which is between said cable end and said pedal end; wherein said pedal is attached to said pedal end of said pedal arm; wherein there is a release cable connected between said release assembly and said pedal arm; wherein there is a firing cable connected between said ball firing assembly and said pedal arm; and wherein said pedal arm includes an adjustable pedal stop on a bottom of said pedal end of said pedal arm.

* * * * *